US005727277A

United States Patent [19]

Chien

[11] Patent Number: 5,727,277

[45] Date of Patent: Mar. 17, 1998

[54] BODY WASHING APPARATUS WITH HANDLE

[76] Inventor: Kuo-Ching Chien, No. 7, Lane 74, Gong 5 Road, Lungtan Hsiang, Tao Yuan Hsien, Taiwan

[21] Appl. No.: 693,472

[22] Filed: Aug. 8, 1996

[51] Int. Cl.[6] ..... A47L 13/07

[52] U.S. Cl. ..... 15/209.1; 15/229.11; 300/21; 401/8; 401/201

[58] Field of Search ..... 15/209.1, 210.1, 15/222, 229.11, 208, 225, 223; 300/21; 601/138, 137; 401/8, 23, 201, 196

[56] References Cited

U.S. PATENT DOCUMENTS

| | | | |
|---|---|---|---|
| 1,794,854 | 3/1931 | Kean | 15/229.11 |
| 4,462,135 | 7/1984 | Sanford | 15/209.1 |
| 5,144,744 | 9/1992 | Campagnoli | 15/209.1 |
| 5,295,280 | 3/1994 | Hudson et al. | 15/222 |
| 5,465,452 | 11/1995 | Girardot et al. | 15/209.1 |
| 5,504,963 | 4/1996 | Bynum et al. | 15/222 |
| 5,555,591 | 9/1996 | Chang | 15/210.1 |

*Primary Examiner*—Gahy K. Graham
*Attorney, Agent, or Firm*—Johnson, Smith, Pence, Densborn, Wright & Heath

[57] ABSTRACT

A body washing apparatus comprising a washing surface portion containing a center, a second material folded into layers to form a band such that one end of said band is pulled through the center of said washing surface portion to form a handle, and a string which is routed through the ends of said handle and tied together such that said washing surface portion and said handle are bound together.

4 Claims, 5 Drawing Sheets

BODY WASHING APPARATUS WITH HANDLE

The present invention relates generally to a body washing apparatus designed to include a handle.

DESCRIPTION OF THE PRIOR ART

While there are many cleaning apparatus designs in the prior art, most relate to manufacturing methods for producing a mesh sponge and to designs used for scrubbing applications in the kitchen. The present invention relates to a different concept that results in a way to securely grasp the cleaning apparatus while it is engaged for its intended purpose.

One example of a prior mesh sponge scheme is disclosed in U.S. Pat. No. 5,144,744 naming Antonio Campagnoli as the inventor. This patent describes a manufacturing method for producing a diamond-mesh polyethylene netting sponge. There are several disadvantages to this type of arrangement. The manufacturing method is complicated as there are numerous supports over which to stretch the mesh material and there is potential for the supports to break. Furthermore, the completed sponge does not provide the functionality of the present invention.

Another example of a prior cleaning device is disclosed in U.S. Pat. No. 4,462,135 naming Howard R. Sanford as the inventor. This invention relates to a scrubbing device used in various kitchen scrubbing and cleaning applications. The method of manufacture is simplistic in nature but it is used to create a scrubbing device that is not conducive to the applications anticipated in the present invention. Consequently, the method of manufacture and materials used in the production of the device are significantly different between this invention and the present invention. The manner of forming plies by pulling the mesh material over itself, the formation of a cylindrical bun and the securing of a core and coil by means of a band differentiates this invention significantly from the present invention. The present invention incorporates significant differences and improvements in terms of the handle design and the construction of the washing surface portion.

The present invention represents an improvement over the prior art primarily due to the superior design of the handle and the simplicity of the manufacturing method.

SUMMARY OF THE INVENTION

The primary object of the present invention is to provide a body washing apparatus that provides superior cleaning capabilities not only with the washing surface area but also with the addition of a hand holding component that allows for greater control and flexibility in using the sponge as well as a means for holding a solid cleaning product.

Another object of the present invention is to make the body washing apparatus simple to manufacture, thus providing an easy to produce, cost effective design that provides the greatest value to the ultimate customer.

These objects are accomplished by the present invention, a body washing apparatus comprising a washing surface portion containing a center, a second material folded into layers to form a band such that one end of said band is pulled through the center of said washing surface portion to form a handle, anda string which is routed through the ends of said handle and tied together such that said washing surface portion and said handle are bound together.

BRIEF DESCRIPTION OF DRAWINGS

In order that the invention can be more clearly ascertained, examples of preferred embodiments will now be described with reference to the accompanying drawings.

FIG. 3(*b*) is a cross sectional view of the formed mesh material for producing the handle portion of the body washing apparatus which illustrates the material being folded inward, FIG. 3(*c*) is an enlarged view of A—A which illustrates the diamond shaped design of the mesh of FIGS. 3(*a*) and 3(*b*).

DESCRIPTION OF PREFERRED EMBODIMENTS

Figure 1:
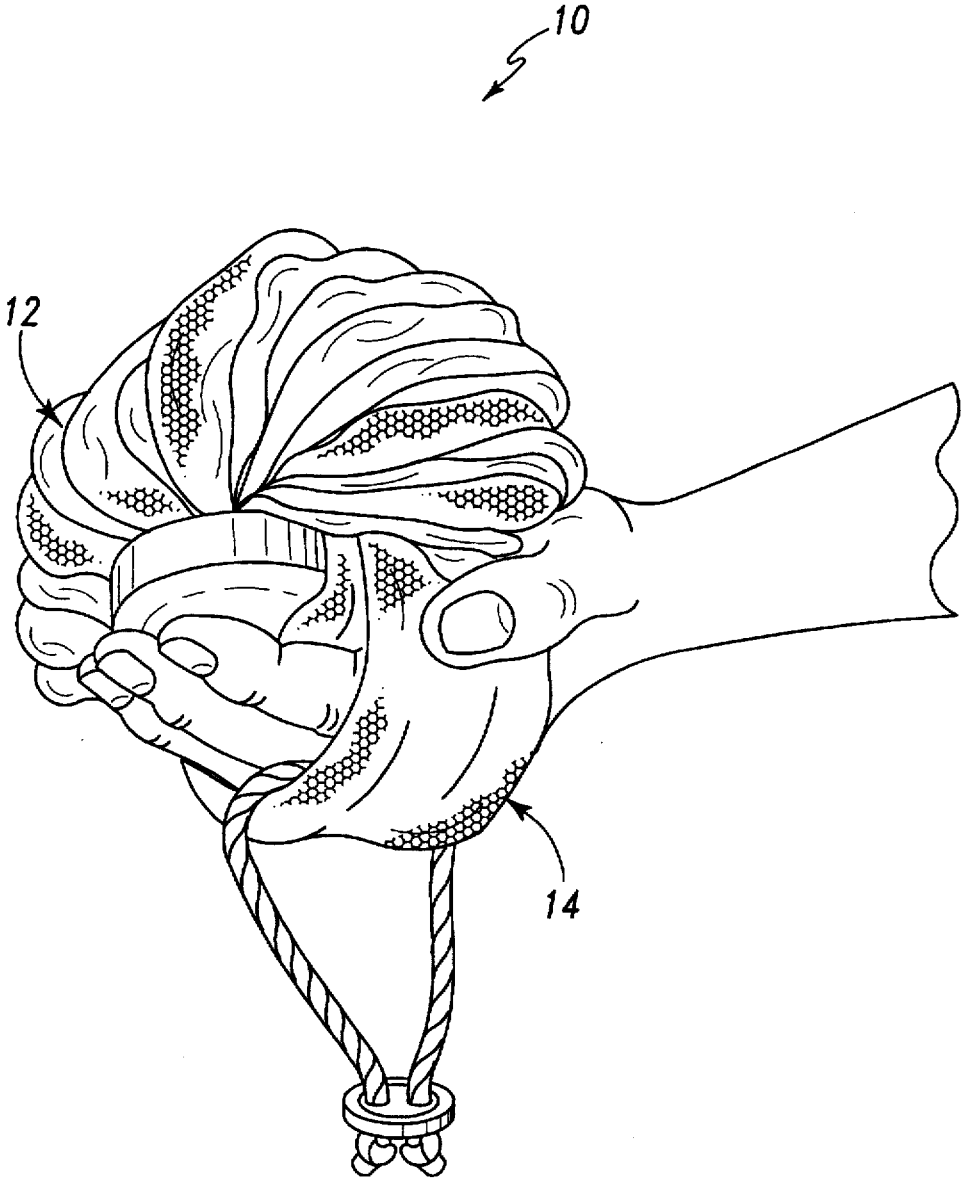
FIG. 1 is a side view of the body washing apparatus as it would normally be used.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a body washing apparatus 10 is shown as it would be generally used. The body washing apparatus 10 includes a washing surface portion 12, a handle 14 for placing one's hand through to hold and maneuver the body washing apparatus 10 and a means of securing the washing surface portion 12 and the handle 14. The means of securing the washing surface portion 12 and the handle 14 is more fully disclosed in the FIG. 5 discussion.

While the washing surface portion 12 and the handle 14 can be made of various soft, pliable materials that withstand water intensive applications, the washing surface portion 12 and the handle 14 are generally made of polyethylene mesh.

Figure 2:
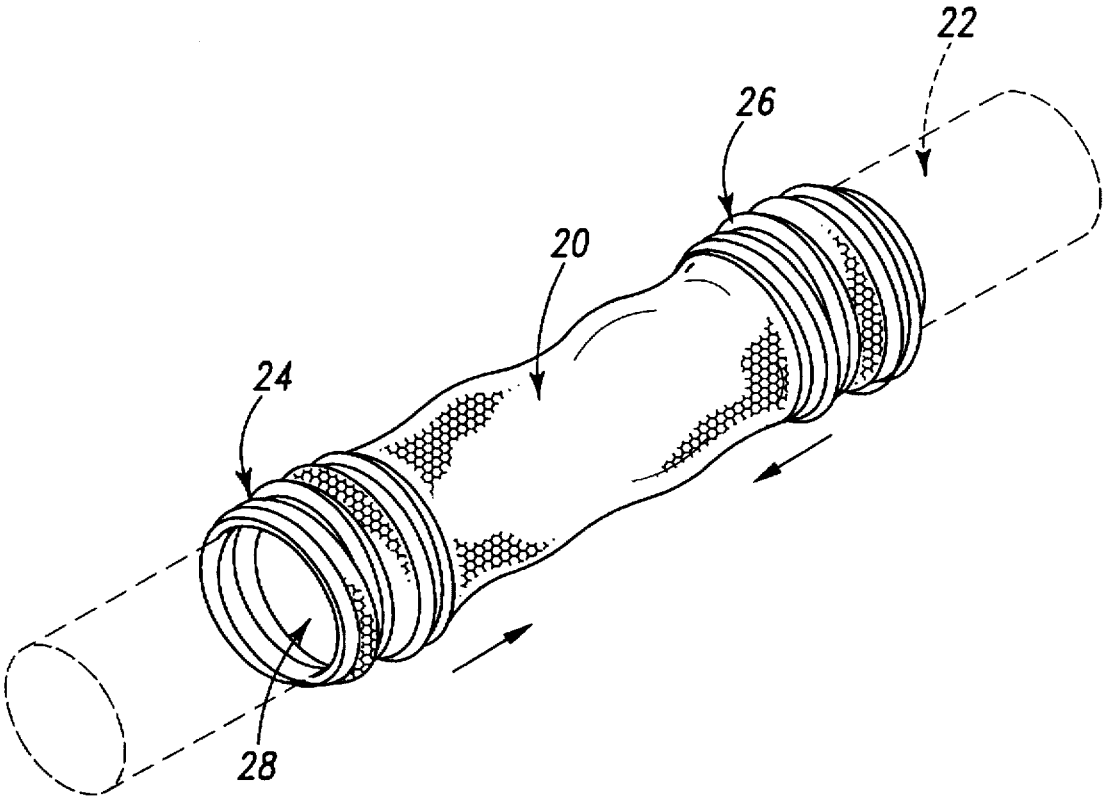
FIG. 2 is a cross sectional view of the formed mesh material for producing the washing surface portion of the body washing apparatus of FIG. 1.
Figure 3A:
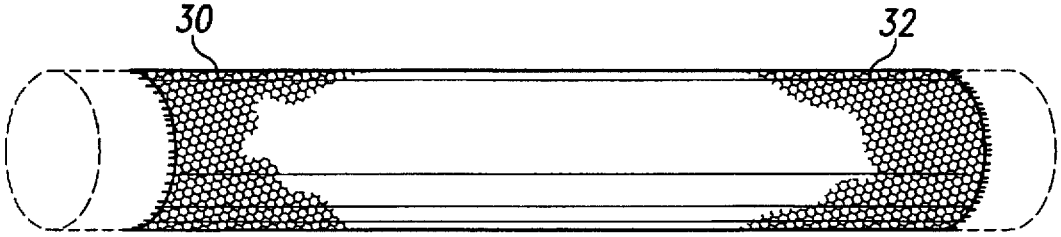
FIG. 3(*a*) is a cross sectional view of the formed.
Figure 3B:
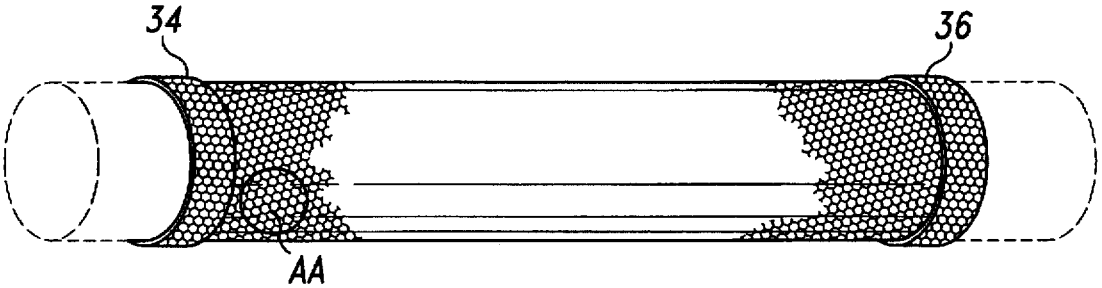
Figure 3C:
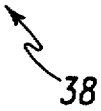
Figure 3C:
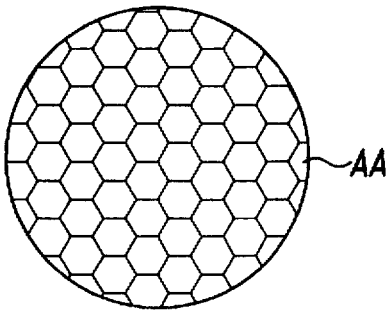

Referring now to FIG. 2, the mesh 20 used to form the washing surface portion 12 is shown. The mesh 20 is formed around a cylindrical tube 22 to create a opening or center 28 in the washing surface portion 12. The center 28 will later be used to attach a handle. The edges 24 and 26 near both ends of the cylindrical tube 22 are folded inward to assist in bunching or moving the mesh 20 toward the middle of the cylindrical tube 22. The force needed to move the mesh 20 inward can be accomplished by hand or may be accomplished by a machine. After the mesh 20 is bunched together in the middle of the cylindrical tube 22, it is removed from the cylindrical tube 22 by sliding the mesh 20 in either direction toward one end of the cylindrical tube 22 and forming a center 28 within the washing surface portion 12. At this point, the washing surface portion 12 is ready to be attached to the handle 14 as described in FIG. 5.

The cylindrical tube 22 may be made of any material and of virtually any length. Generally, however, the material used is a smooth extruded metal approximately 6 to 8 inches in length. The longer the cylindrical tube 22 the fuller and thicker the washing surface portion 12 of the apparatus.

Referring now to FIGS. 3(*a*), 3(*b*) and 3(*c*) the second material or second mesh 30 and second cylindrical tube 32 used to produce the handle 14 are shown. The enlarged view A—A in FIG. 3(*c*) shows the detail of the second mesh which is generally a diamond shaped design.

Figure 4:
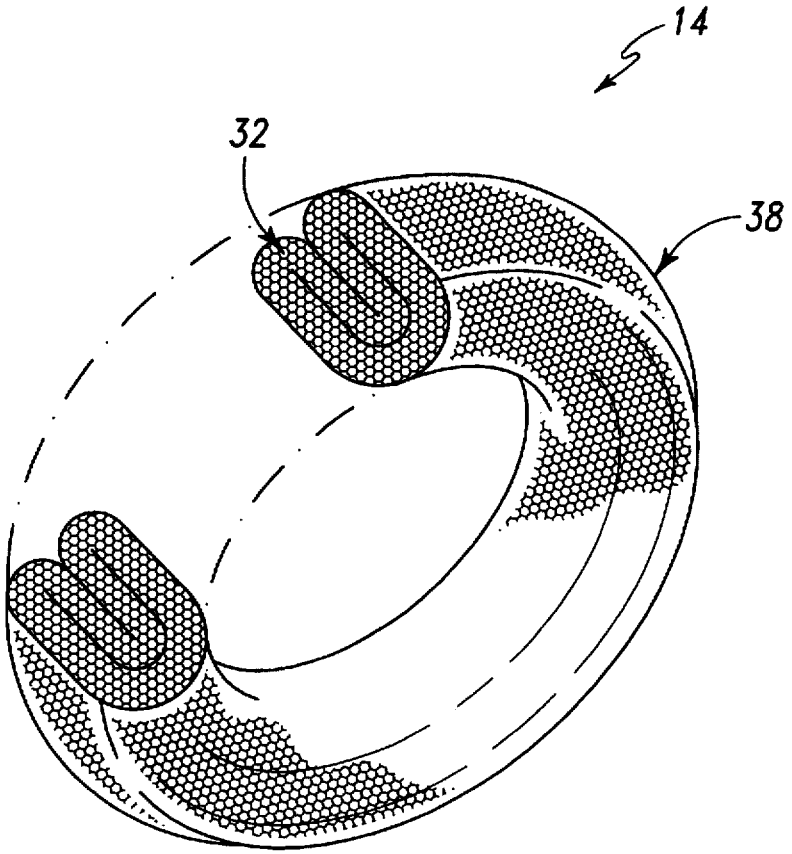
FIG. 4 is a cross sectional view of the handle portion of the body washing apparatus of FIG. 1.

FIG. 3(*b*) and 3(*c*) illustrate how the second mesh 30 is positioned to form the band 38 illustrated in FIG. 4 which is used to create the handle 14. The second mesh 30 is folded inward toward the middle of the second cylindrical tube 32 in equal amounts on both ends 34 and 36. For instance, if the first fold on each of the ends 34 and 36 uses a quarter inch of second mesh 30 overlap, the next fold will also be a quarter inch in depth and so on until the center of the second cylindrical tube 32 is reached. At the point in which the middle of the second cylindrical tube 32 is reached, the second mesh 30 is slid in either direction toward the end of the second cylindrical tube 32 and the band 38 is formed.

The second material 32 is generally a polyethylene mesh and the consistency of the second material 32 is such that by folding it over several times over, the second material 32 sticks to itself and manages to hold together prior to being fastened to the washing surface portion 12.

It should be noted here that the cylindrical tube 22 and the second cylindrical tube 32 may be the same tube in practice, both in terms of size and material or it is possible for them to be different sizes and materials depending on the desired effect, i.e. thickness, size and look of the body washing apparatus 10.

Referring now to FIG. 4, a band 38 used to form the handle 14 is shown. The handle 14 is formed by folding the band 38 onto itself to form multiple layers or plies. The number of layers determines the thickness of the handle 14 and the number of times the band 38 is folded. Generally, there are approximately 3 layers in the preferred embodiment.

Figure 5:
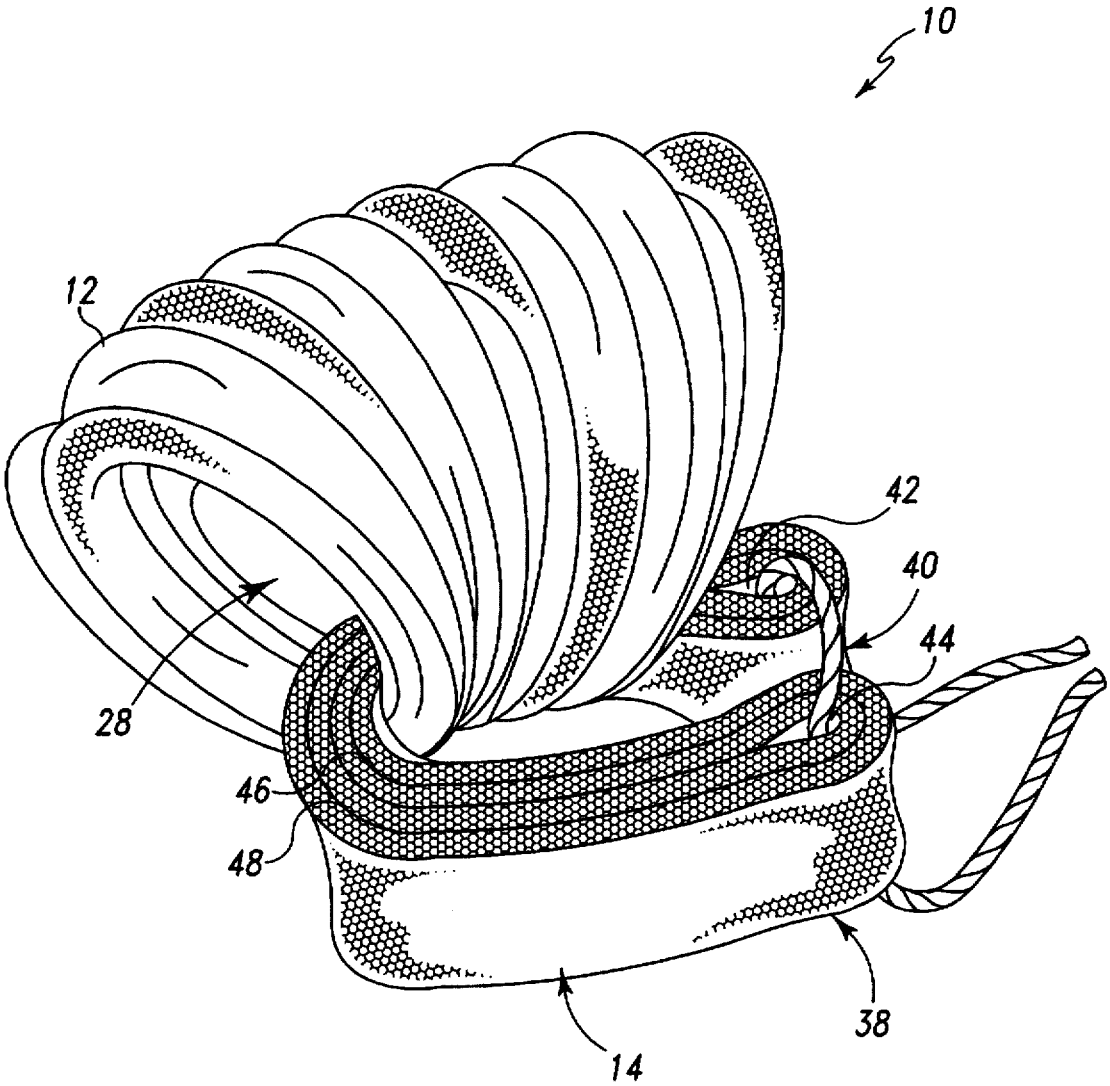
FIG. 5 is a side view showing the method in which the washing surface portion and the handle are secured to one another to form the body washing apparatus.

Referring now to FIG. 5, the apparatus 10 is shown being fastened together. The band 38 is routed or inserted through the center 28 of the washing surface portion 12 and a string or other fastening device 40 is routed or inserted through the center 28 of the washing surface portion 12 and around two sides 42 and 44 of the band 38 to form the handle 14. The string 40 is then tied in a knot. In this manner, the handle 14 is secured to the washing surface portion 12 and the washing surface portion 12 is not allowed to disassemble. Furthermore, a plurality of loops 46 and 48 are formed in the handle 14 so that a hand may be placed through the loop 48 to hold onto the apparatus and guide it to its proper location and a bar of soap or other similar solid bath cleaning product may be placed through loop 46 to allow for soap to infiltrate the washing surface portion 12 of the apparatus 10.

The apparatus is also conducive to other types of cleaning products. For instance, market research predicts that liquid body wash will encompass more than fifty percent (50%) of the bath products market by the year 2000. The washing surface portion 12 of this design allows for the use of liquid body wash by applying the liquid body wash directly to the washing surface portion 12 of the apparatus 10.

The string or fastening device 40 may be nylon string or any other type of thin, flexible material that will withstand water. The handle 14 and band 38 may be made of the same polyethylene mesh as the body washing portion. It is desirable, however, to make the handle a different colored mesh in order to locate the handle more easily when first picking up the apparatus 10.

Other modifications may be made without departing from the ambit of the invention, the nature of which, is to be determined from the foregoing description and the appended claim.

What is claimed is:

1. A body washing apparatus, comprising:

a washing surface portion defined by a tubular member made of a first material, said member, containing a center passage therethrough;

a second material folded into layers to form an elongated band having opposite ends, such that one end of said band is pulled through said center passage of said tubular member to form a handle; and a string which is routed through the ends of said handle and tied together such that said washing surface portion and said handle are bound together.

2. A body washing apparatus as defined in claim 1, wherein said first material is polyethylene mesh.

3. A body washing apparatus as defined in claim 1, wherein said second material is polyethylene mesh.

4. A body washing apparatus as defined in claim 1, wherein said string is made of nylon.

* * * * *